United States Patent [19]

Hostetler

[11] Patent Number: 4,610,354

[45] Date of Patent: Sep. 9, 1986

[54] MOUNTING AND DISPLAY CARD FOR HANDLE-OPERATED TOOL

[75] Inventor: Glenn Hostetler, Arcadia, Calif.

[73] Assignee: S.M.S. Industries, Inc., Glendale, Calif.

[21] Appl. No.: 780,012

[22] Filed: Sep. 25, 1985

[51] Int. Cl.[4] ..... A45C 11/26

[52] U.S. Cl. ..... 206/349; 206/45.14; 206/477; 206/481

[58] Field of Search ..... 206/349, 45.14, 477, 206/479, 481

[56] References Cited

U.S. PATENT DOCUMENTS

| | | | |
|---|---|---|---|
| 3,338,408 | 8/1967 | Evans | 206/349 |
| 3,516,585 | 6/1970 | Inwood | 206/349 |
| 3,674,138 | 7/1972 | Gilmour | 206/349 |
| 3,891,088 | 6/1975 | Huebner | 206/349 |
| 4,165,805 | 8/1979 | Fethke et al. | 206/349 |
| 4,179,029 | 12/1979 | Fethke et al. | 206/349 |
| 4,359,158 | 11/1982 | Gringe | 206/349 |

*Primary Examiner*—Joseph Man-Fu Moy

*Attorney, Agent, or Firm*—Thompson, Birch, Gauthier & Samuels

[57] ABSTRACT

A mounting and display card for a tool of the type having a pair of pivotably interconnected jaws, each jaw being connected to a handle, and the handles being pivotably interconnected and adjustable between open and closed positions to open and close the jaws. The card includes a pair of overlapping panels, each having an upper portion adapted to underlie the jaws of the tool, and a lower portion defining a display area with a margin adapted to underlie one of the handles of the tool. The panels are connected to each other for relative pivotal movement about an axis which is coincident with the pivotal axis of the tool handles, and connectors are employed to detachably secure each handle of the tool to one of the panels along a margin thereof. The panels are dimensioned and configured such that when the tool handles are closed, the display area of one panel is overlapped and hidden from view by the display area of the other panel, and when the tool handles are opened, the display areas of both panels are visible.

6 Claims, 4 Drawing Figures

MOUNTING AND DISPLAY CARD FOR HANDLE-OPERATED TOOL

BACKGROUND OF THE INVENTION

1. Field of the Invention

This invention relates to mounting and display cards for tools of the type having jaws which are opened and closed by elongated handles.

2. Description of the Prior Art

Handle-operated tools such as shears, loppers or the like are conventionally secured to mounting and display cards in a manner which prevents the consumer from operating the tool in order to observe and judge its functional characteristics. Moreover, such mounting and display cards have only limited visible areas on which information can be printed and readily displayed to a prospective purchaser.

SUMMARY OF THE PRESENT INVENTION

An object of the present invention is to provide a mounting and display card for a handle-operated tool which readily accommodates movement of the handles, thereby allowing a prospective purchaser to operate the tool to an extent sufficient to observe and judge its functional characteristics.

Another object of the present invention is the provision of a mounting and display card having increased visible areas on which advertising messages, specifications, operating instructions and other like information can be printed.

DETAILED DESCRIPTION OF DISCLOSED EMBODIMENT

Figure 1:
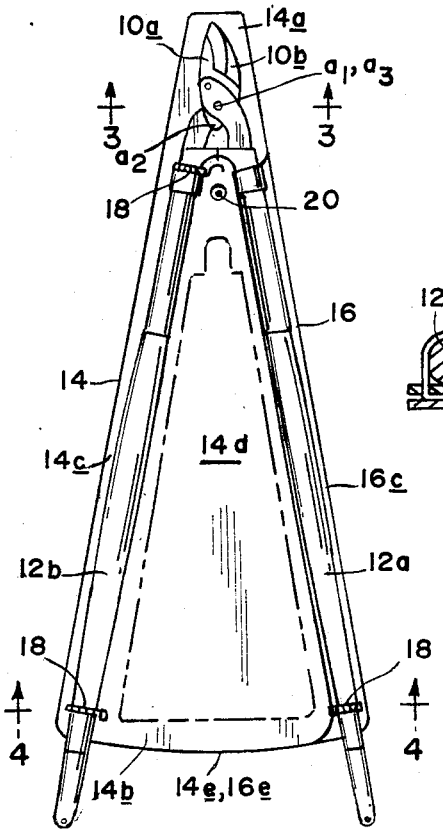
FIG. 1 is a top plan view of a mounting and display card in accordance with the present invention, showing a tool mounted thereon with the handles in the closed position.
Figure 3:
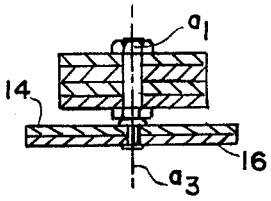
FIGS. 3 and 4 are sectional views respectively taken along lines 3—3 and 4—4 of FIG. 1.
Figure 2:
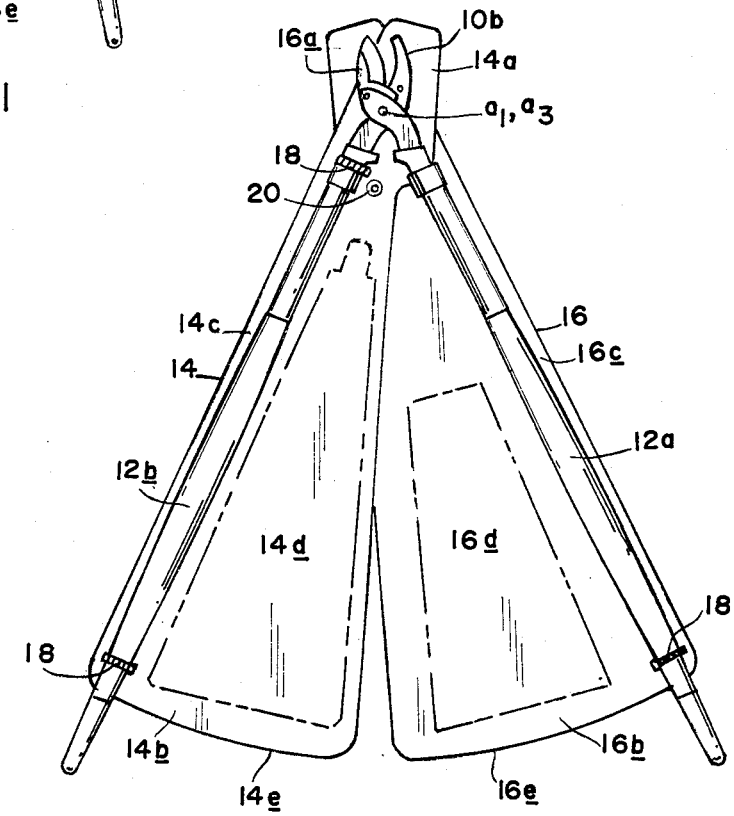
FIG. 2 is a view similar to FIG. 1, but showing the tool handles in the open position.

With reference to the drawings, a tool such as for example a lopper is shown having a pair of pivotably interconnected jaws 10*a*, 10*b*, each jaw being connected to a respective one of two handles 12*a*, 12*b*. The handles are interconnected for pivotal adjustment about a first axis $a_1$ between a closed position closing the jaws 10*a*, 10*b* as shown in FIG. 1, and an open position opening the jaws as shown in FIG. 2. Typically, the tool will have a compound action wherein the pivot axis $a_2$ of the jaws is offset from the pivot axis $a_1$ of the handles.

The mounting and display card of the present invention consists essentially of a pair of overlapping panels 14, 16. The panels respectively have upper portions 14*a*, 16*a* and lower portions 14*b*, 16*b*. The upper portions are arranged to underlie the jaws of the tool, and the lower portions have margins 14*c*, 16*c* arranged to underlie the handles of the tool. The lower panel portions further define display areas 14*d*, 16*d* on which can be printed advertising messages, operating instructions, tool specifications, etc.

Figure 4:
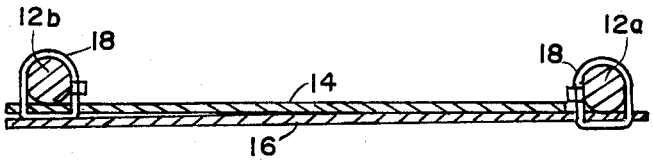

The panels are interconnected by a rivet or the like for relative pivotal movement about a third axis $a_3$ which is coincident with the pivotal axis $a_1$ of the tool handles 12*a*, 12*b*. The tool handles 12*a*, 12*b* are each detachably connected to one of the margins 14*c*, 16*c* of the panels. Preferably, such connections are provided by plastic loops 18 which as shown in FIG. 4, partially encircle the handles on the front sides of the panels and which extend through openings in the panels to the back sides thereof.

Preferably, one of the loops 18 holds one of the handles at a location closely adjacent to the pivotal axis $a_3$ of the panels, whereas other loops 18 connect each of the handles to one of the panels at locations adjacent to their bottom edges 14*e*, 16*e*.

The upper portions 14*a*, 16*a* of the panels are relatively small in area as compared to the lower portions 14*b*, 16*b*, and the lower portions have side edges which extend angularly outwardly from the panel pivot axis $a_3$ towards the lower panel edges.

Preferably, the lower panel edges are arcuate and have the same radius of curvature extending from the panel pivot axis $a_3$.

When the tool handles 12*a*, 12*b* are closed as shown in FIG. 1, the display area 16*d* of panel 16 is overlapped and hidden from view by the display area 14*d* of panel 14. The entire closed package consisting of the tool and card is compact and capable of being stored in a neat and attractive condition, for example by being suspended from a hook or the like (not shown) extending through aligned openings 20 in both panels.

A prospective purchaser can pivotably manipulate the tool handles in order to observe and judge the functional characteristics of the tool, while the tool remains secured to the display card. When the handles are opened, as shown in FIG. 2, both display areas 14*d*, 16*d* are visible.

I claim:

1. A mounting and display card for a tool of the type having a pair of pivotably interconnected jaws, each jaw being connected to a handle, and said handles being pivotably interconnected and adjustable between open and closed positions to open and close said jaws, said card comprising: a pair of overlapping panels, each panel having an upper portion adapted to underlie the jaws of said tool, and having a lower portion defining a display area with a margin adapted to underlie one of the handles of said tool; means for pivotably interconnecting said panels; and connecting means for detachably securing each handle of said tool to one of said panels, said panels being dimensioned and configured such that when the handles of said tool are closed, the display area of one panel is overlapped and hidden from view by the display area of the other panel, and when the handles of said tool are opened, the display areas of both panels are visible.

2. The mounting and display card of claim 1 wherein said connecting means comprise loops which partially encircle said tool at a plurality of locations and which extend through openings in said panels.

3. The mounting and display card of claim 1 wherein the pivotal axis of said panels is coincident with the pivotal axis of said handles.

4. The mounting and display card of claim 3 wherein the upper portions of said panels are relatively small in area as compared to the areas of the lower portions thereof.

5. The mounting and display card of claim 4 wherein said lower portions have side edges which extend angularly outwardly from the pivotal axis of said panels.

6. The mounting and display card of either of claims 4 or 5 wherein said lower portions have arcuate bottom edges with the same radius of curvature extending from the pivotal axis of said panels.

* * * * *